US005290415A

United States Patent [19]

Shimamune et al.

[11] Patent Number: 5,290,415

[45] Date of Patent: Mar. 1, 1994

[54] ELECTROLYTIC ELECTRODE

[75] Inventors: Takayuki Shimamune; Yasuo Nakajima, both of Tokyo, Japan

[73] Assignee: Permelec Electrode Ltd., Fujisawa, Japan

[21] Appl. No.: 934,229

[22] Filed: Aug. 25, 1992

[30] Foreign Application Priority Data

Aug. 30, 1991 [JP] Japan ..... 3-246597

[51] Int. Cl.[5] ..... C25B 11/08

[52] U.S. Cl. ..... 204/290 F

[58] Field of Search ..... 204/290 F; 429/40; C25B 11/06, 11/08, 11/10

[56] References Cited

U.S. PATENT DOCUMENTS 4,481,097 11/1984 Asano et al. ..... 204/290 R 4,517,068 5/1985 Hinden et al. ..... 204/290 F

*Primary Examiner*—Kathryn Gorgos

*Attorney, Agent, or Firm*—Sughrue, Mion, Zinn, Macpeak & Seas

[57] ABSTRACT

An electrolytic electrode comprising a substrate made of a valve metal, an intermediate layer formed on a surface of the substrate containing an oxide of at least one metal selected from the group consisting of niobium, tantalum, titanium, and zirconium, and a coating layer formed on the intermediate layer containing an iridium-tantalum mixed oxide and platinum. In separate embodiments of the invention, the intermediate layer may contain platinum and/or a stabilizing layer formed on the coating layer containing an oxide of at least one metal selected from the group consisting of tin, titanium, tantalum, zirconium, and niobium.

8 Claims, No Drawings

ELECTROLYTIC ELECTRODE

FIELD OF THE INVENTION

The present invention relates to an electrode for use in electrolysis (hereinafter referred to as "electrolytic eletrode") having good durability. More particularly, this invention relates to an electrolytic anode containing platinum suitable for use in electrolytic metal plating or electrolytic surface treatment, from which oxygen is evolved during electrolysis.

BACKGROUND OF THE INVENTION

Electrolytic plating or electrolytic surface treatment of metals has been conducted using an article to be treated as the cathode and using, as the counter electrode, a soluble anode or an insoluble anode comprising a corrosion-resistant material such as lead or a lead alloy.

Soluble anodes have conventionally been used extensively because, theoretically, electrolytic plating operations employing a soluble anode can be conducted continuously without changing the composition of the electrolyte solution, that is, while the same metal as that deposited on the cathode (from the electrolyte solution) is released from, and supplied by, the anode in an amount equal to the deposited amount. However, use of soluble anodes has generally been defective. For example, the balance between the anode and cathode is disturbed resulting in the need to regulate the composition of the electrolyte solution or frequently replace the anode with a fresh one. Thus, the maintenance of the electrolytic system is troublesome. Another problem associated with the use of soluble anodes is that the distance between the cathode and anode is not constant. Therefore, soluble anodes have been unable to meet the recent demand for higher quality, higher speed, and energy saving, and as a result, insoluble anodes which do not dissolve in electrolytic baths (which changes the composition thereof) and which can be treated independently of electrodes have come to be used.

Lead or a lead alloy is used as a material for such insoluble anodes. The lead-based anode has the merits of inexpensiveness and is easily shaped. However, the use of such lead-based anodes are problematic. For example, when electrolysis is conducted at a high current density, i.e., at a high speed, the electrode material dissolves into the electrolyte solution at a rate of several milligrams per W.H to contaminate the electrolyte solution, leading to poor product quality. Another problem exists if the electrolysis is continued further. In such a case, the lead or lead alloy itself softens resulting in impaired dimensional stability. Although a platinum-plated titanium electrode is also being used as an insoluble electrode (in addition to the lead-based electrode), it is expensive, and; disadvantageously, its life is greatly shortened if on-off operations are repeatedly conducted.

On the other hand, a so-called dimensionally stable electrode (DSE) was developed which comprises a valve metal substrate and, provided thereon, a coating mainly comprising an oxide of a platinum group metal. Use of this electrode, which is regarded as free from most of the conventional problems, is spreading rapidly. In particular, in the caustic soda-producing electrolysis not involving oxygen generation, which is the mainly employed technique in the present-day industrial electrolysis for caustic soda production, almost 100% of the electrolytic cells employ a DSE.

Hitherto, it has been attempted to use the abovedescribed DSE in electrolysis involving oxygen generation, and the use thereof is rapidly expanding in recent years. One example of a DSE is an electrode comprising a substrate made of titanium or a titanium alloy and, formed on the substrate, an oxide coating containing iridium as an electrode material, and titanium or tantalum as a stabilizer. The most serious problem associated with these kinds of electrodes has been that when used in oxygen-generating electrolysis, the electrode forms a passive-state layer at the interface between the coating and the substrate and becomes unable to be used any longer before the electrode material is completely consumed. As a result of studies by the present inventors, they succeeded in inhibiting the formation of such a passive-state layer by providing a thin layer of an electrically conductive oxide at the coating-substrate interface.

However, even in the case of such an insoluble metal electrode having a thin layer of an electrically conductive oxide, its life in oxygen-generating electrolysis is one year at the most when the electrode is used at a current density of about 100 $A/dm^2$. This life is extremely short as compared to the lives of several years or more which the insoluble metal electrode has when used in soda-producing electrolysis. Therefore, it has been desired to increase the life of the insoluble metal electrodes used in oxygen-generating electrolysis.

SUMMARY OF THE INVENTION

An object of the present invention is to provide an insoluble metal electrode which is mainly used in oxygen-generating electrolysis, and which can be used over a long period of time while maintaining stable electrolysis conditions, thereby overcoming the problems associated with the electrodes known in the art.

In a first embodiment of the present invention, an electrolytic electrode is provided which comprises a substrate made of a valve metal, an intermediate layer formed on a surface of the substrate and containing an oxide of at least one metal selected from the group consisting of niobium, tantalum, titanium, and zirconium, and a coating layer formed on the intermediate layer and containing an iridium-tantalum mixed oxide and platinum.

In a second embodiment of the present invention, an electrolytic electrode is provided which is the same as the electrode provided in the first embodiment of the invention except that platinum is added to the intermediate layer.

In a third embodiment of the present invention, an electrolytic electrode is provided which is the same as the electrode provided in the first embodiment of the invention except that a stabilizing layer containing an oxide of at least one metal selected from the group consisting of tin, titanium, tantalum, zirconium, and niobium is formed, on the coating layer.

In a fourth embodiment of the present invention, an electrolytic electrode is provided which is the same as the electrode provided in the third embodiment of the invention except that platinum is added to the intermediate layer.

DETAILED DESCRIPTION OF THE INVENTION

A characteristic feature of the electrode according to the present invention resides in a small amount of platinum in the coating layer.

In preparing an insoluble metal electrode, it is extremely difficult to deposit platinum on the surface of an anode in the form of a platinum oxide which itself is crystalline. Therefore, platinum, in most cases, is deposited as platinum metal. It is known that, as in the case of platinum-plated titanium electrodes and similar electrodes, the deposited platinum metal has considerably inferior corrosion resistance to oxide coatings such as an iridium oxide coating.

However, as a result of intensive studies by the present inventors, it has now been found that when iridium containing a minute amount of platinum is subjected to pyrolysis, an iridium oxide in an extremely good crystalline state is formed, and the minute amount of platinum is present in the iridium oxide as a solid solution with the oxide. The present invention has been completed based on this finding.

In electrodes having an iridium-tantalum mixed oxide coating layer, X-ray diffraction patterns for the mixed oxide coating layers usually show that the iridium-tantalum coating layers have a rutile-type crystalline phase containing an iridium oxide. However, these crystallites are dispersed because of the poor crystallizability of the oxide and the apparent crystallite sizes usually are 200 Å or less. It can be easily presumed that these electrodes, in which the mixed oxide coating layers have such a crystalline state, have insufficient corrosion resistance and durability although they have a sufficient activity as an electrode.

According to the present invention, by adding a minute amount of platinum, which has insufficient corrosion resistance when used alone, into a coating layer containing iridium and tantalum, the rutile-type crystalline phase of the iridium and tantalum is further stabilized.

A valve metal is used as the material for the substrate in the electrolytic electrode of the present invention. Preferred examples of the valve metal include titanium and titanium alloys. The substrate can be in any suitable form such as in the form of a net, perforated plate, plate, or rod, according to the use of the electrolytic electrode to be produced. It is desirable for the substrate to be activated beforehand by blasting or acid-washing in order to improve the adhesion between the substrate and an intermediate layer.

An intermediate layer which contains a semiconducting oxide such as an oxide of at least one metal selected from the group consisting niobium, tantalum, titanium, and zirconium is formed on a surface of the substrate. It is possible to add platinum to the semiconducting oxide. The semiconducting oxide is not substantially passivated and retains electrical conductivity even when oxygen generated during electrolysis migrates to the intermediate layer to form, for example, a rutile-type stoichiometric oxide. Since the preferred crystalline structure for the coating layer (described hereinbelow) is of a rutile type, it is desirable for the intermediate layer to also have a rutile-type crystalline structure.

In order to ensure electrical conductivity and a rutile-type crystalline structure for the intermediate layer, preferably, the intermediate layer is made of an oxide of a mixture containing 50 mol % or more, more preferably, from 70 to 95 mol % titanium, per 100 mol % of all the intermediate layer materials, with the remainder being tantalum and/or niobium. Methods for forming this intermediate layer are not particularly limited. It is, however, most advantageous to use a thermal decomposition method from the viewpoints of obtaining an electrically conductive oxide and ease of operation.

When the insoluble electrode is continuously used over a long period of time under severe conditions, e.g., in a high-speed continuous zinc-plating line or similar plating line or electrolytic copper foil production line in which electrolysis is conducted at an anode current density of about from 100 to 200 Å/dm$^2$, there are cases where even the intermediate layer containing an oxide of at least one metal selected from the group consisting of niobium, tantalum, titanium, and zirconium cannot sufficiently prevent the migration of oxygen and the formation of a passive-state layer. In such a case, the formation of a passive-state layer can be effectively prevented by adding platinum, which has an oxygen-barrier effect, to the intermediate layer.

It is known that the oxygen overvoltage in sulfuric acid of platinum is about 300 to 400 mV higher than that of iridium oxide. Therefore, it is expected that when an iridium oxide-based mixed oxide is used as an electrode material, no reaction occurs on the surface of the platinum present with the mixed oxide. However, considerable electrolysis also takes place on the platinum surface. Because of this, and because platinum has far lower corrosion resistance than iridium oxide, there is a problem that if platinum alone is used to constitute an intermediate layer, a coating layer overlying the intermediate layer peels-off the intermediate layer.

The present inventors have found that when the content of platinum in the intermediate layer is 50 mol % or less per 100 mol % of all the intermediate layer materials, this intermediate layer has advantages in that the actual oxygen-evolving potential is extremely high, electrolysis occurs with difficulty on the platinum surface, and the platinum can exhibit an exceedingly high oxygen-barrier effect, so long as the intermediate layer is as thin as 1 μm or less.

A coating layer which contains an iridium-tantalum mixed oxide and platinum is formed on the surface of the intermediate layer. The content of platinum in the coating layer is generally from 0.5 to 10 mol %, preferably from 2 to 6 mol %, per 100 mol % of all the coating layer materials. This is because, as described hereinabove, (1) the effect of the addition of platinum is sufficiently produced when platinum is added only in an amount required to allow the platinum to be solid-solubilized in the crystalline structure of the iridium and tantalum to form a good crystalline structure, and (2) if the platinum content is too high, the platinum functions as an electrode material during electrolysis and is apt to dissolve into the electrolyte solution, leading to breakage of the coating layer.

The coating layer comprises a mixed oxide of iridium and tantalum, besides platinum described above. It is desirable for the content of iridium to be higher than that of tantalum. This is because if the mixed oxide contains tantalum in an amount larger than that of iridium, the mixed oxide has difficulty forming a stable rutile-type crystalline structure and use of an electrolytic electrode having such a coating layer in oxygen-generating electrolysis results in a slight increase in potential. Since tantalum, which is added as a stabilizer, is effective in further improving durability, it is desirable to add tantalum in an amount of at least the lower limit specified below, in order to improve the stability of the electrode to be produced. The preferred ranges of the amounts of platinum, iridium, and tantalum constituting the coating layer are from 0.5 to 10 mol %, from 50 to 70 mol %, and from 20 to 49.5 mol %, respectively, per 100 mol % of all the coating layer materials, respectively.

Methods for forming this coating layer are not particularly limited. It is, however, desirable if the coating layer is formed by a thermal decomposition method like the intermediate layer. For example, there is a method in which a mixture obtained by combining salts of platinum, iridium, and tantalum, e.g., chloroplatinic acid, iridium chloride, and tantalum chloride, in a proportion so as to result in a desired composition, is dissolved in an aqueous solution of hydrogen chloride or in an organic alcohol solution to obtain a coating liquid. This coating liquid is coated on the intermediate layer, dried, and the dry coating is then calcined at a temperature between 450 to 550° C. in air or in an atmosphere regulated to have an oxygen concentration of about from 15 to 30%. By repeating this procedure, a coating layer having a predetermined thickness can be obtained. Since the intermediate layer is made of a semiconducting oxide, too large a thickness of the coating layer poses the problem of heat generation due to the electrical conductivity of the coating layer. From the standpoint of avoiding this heat generation problem and in view of the fact that the coating layer can act as a substantial oxygen barrier, a smaller thickness is desirable for the coating layer. Specifically, the preferred range of the thickness of the coating layer is from 0.1 to 2 μm.

Even the electrode described above, which comprises a valve metal substrate and, formed thereon, an intermediate layer and a coating layer and which shows improved corrosion resistance and stability due to such a structure, is not perfect under all conditions and may have a shorter life according to use. If a substance which accelerates consumption of the electrode, e.g., an organic substance, is present in the electrolyte solution, the life of the electrode is considerably shortened. Therefore, according to the present invention, the electrode can be made to have far more improved stability by further providing a stabilizing layer on the surface of the coating layer.

It is desirable for the stabilizing layer if it is porous to have low activity as an electrode, and to contain an electrically conductive oxide. This oxide, in the present invention, is an oxide of at least one metal selected from the group consisting of tin, titanium, tantalum, zirconium, and niobium. This oxide can be an oxide of any one of these metals or an oxide of a combination of two or more of these metals. The stabilizing layer can be formed by a method similar to the above-described method for forming the intermediate layer; that is, by coating the coating layer with an aqueous or alcoholic solution of a metal chloride(s) or metal alkoxide(s), drying and calcining the coating. Although the mechanism of the inhibition of electrode consumption due to the stabilizing layer has not been elucidated, it is presumed that the stabilizing layer serves to inhibit a corrosive substance in the electrolyte solution from diffusing into the electrode, thereby preventing electrode consumption.

The degree of the comsumption of the electrode, on which a stabilizing layer of the above-described kind has been formed, depends to some extent on the proportion of the metal(s) in the stabilizing layer to the iridium in the coating layer. In general, the larger the thickness of the stabilizing layer, the less the electrode is consumed. However, too large a thickness of the stabilizing layer poses a problem in that due to an increase in potential, the life of the electrode is shortened.

The present invention will be explained below in more detail by reference to the following examples which illustrate production methods for electrolytic electrodes according to the present invention. However, the electrolytic electrode of the present invention is not limited thereto. Unless otherwise indicated, all parts percents, ratios and the like are by weight

EXAMPLE 1

Commercially available titanium plates were sandblasted to roughen the surface of each plate. These plates were cleaned and then washed in 25 wt % sulfuric acid at 90° C. for 4 hours to activate the roughened surfaces. the resulting plate surfaces were coated with a 5% aqueous hydrogen chloride solution containing titanium chloride and tantalum chloride in a molar ratio of 20:80, respectively, and the coating was dried in air and then calcined at 530° C. for 10 minutes. This procedure was repeated twice, thereby forming an intermediate layer having a thickness of about 0.5 μm.

Chloroiridic acid was mixed with butyl tantalate in a proportion so as to result in an iridium:tantalum molar ratio of 6:4, respectively. On the other hand, 100 parts by volume of butyl alcohol was mixed with 10 parts by volume of hydrochloric acid. To this liquid mixture, there were added the above-prepared chloroiridic acid-butyl tantalate mixture and chloroplatinic acid in various proportions so that the amounts of platinum, based on the total amount of the iridium and tantalum, were 0, 0.5, 1, 3, 5, 10, and 20% by mol. Thus, coating liquids having various platinum contents were prepared. Each of the coating liquids were coated on the intermediate layer formed above, and the coating was dried and then calcined in air at 530° C. for 10 minutes. This coating and calcination operation was repeated four times to form a coating layer. Thus, electrode samples were prepared. Each electrode sample was subjected to a life test in which electrolysis was conducted at a current density of 100 $A/dm^2$ in an electrolyte solution prepared by dissolving 200 ppm of glue in 150 $g/dm^3$ sulfuric acid. The results obtained are shown in Table 1.

The results in Table 1 show that electrode life was lengthened by the addition of platinum to the coating layer, but when the coating layer had a platinum content of 20%, the electrode life was short, far from being improved. It can, therefore, be thought that the practical range of the amount of platinum to be added to the coating layer is up to about 10%.

EXAMPLE 2

Using a coating liquid containing titanium, zirconium, and tantalum in a molar ratio of 60:20:20, an intermediate layer was formed on the surface of each of the same substrates as those in Example 1 under the same conditions as in Example 1. Subsequently, coating liquids each containing platinum, iridium, and tantalum in which the amount of platinum was 1 mol % based on the total amount of the three metals and the sum of iridium and tantalum was 99 mol % based on the total amount of the three metals with the molar ratio of iridium to tantalum being varied as shown in Table 2, were separately coated on the surface of the intermediate layer formed above and the coatings were dried and calcined in the same manner as in Example 1. For each coating liquid, this procedure was repeated four times, as in Example 1, thereby forming a coating layer by a thermal decomposition method. Thus, electrode samples were prepared. Each electrode sample was subjected to a life test in the same manner as in Example 1, and the results obtained are shown in Table 2.

For purposes of comparison, an electrode sample was prepared in the same manner as in the above except that a coating liquid containing iridium, tantalum, and platinum in a molar ratio of 70:29:1 respectively, was used; also, a coating layer was formed directly on a substrate without forming an intermediate layer. The life of this comparative electrode was similarly tested and the result obtained is shown in Table 2.

The results in Table 2 show that electrode samples having higher iridium:tantalum ratios and an intermediate layer were very effective in lengthening electrode life. The comparative electrode sample having no intermediate layer had ended its life, leaving 90% or more of the electrode materials (iridium and tantalum).

EXAMPLE 3

Commercially available titanium plates were sandblasted to roughen the surface of each plate. These plates were cleaned and then washed in 25 wt% sulfuric acid at 90° C. for 4 hours to activate the roughened surfaces. A first solution of a 5% aqueous hydrogen chloride solution containing, dissolved therein, titanium chloride and tantalum chloride in amounts such that the titanium: tantalum molar ratio was 2:8, respectively, was mixed, in various proportions, with a second solution of a 5% aqueous hydrogen chloride solution containing chloroplatinic acid in an amount such that the molar content of platinum in this second solution was equal to that of the sum of titanium and tantalum in the first solution, thereby to prepare coating liquids in which the molar ratio of the sum of titanium and tantalum to platinum varied as shown in Table 3 (platinum contents being 0, 1, 5, 10, 25, 50, 70, and 90 mol %). The thus-obtained coating liquids were separately coated on the activated surfaces of the substrate plates, and the coatings were dried in air and then calcined at 530° C. for 10 minutes. This procedure was repeated twice to form intermediate layers.

Each of the resulting substrate plates on which an intermediate layer had been thus formed was examined for oxygen-evolving potential in 150 g/dm$^2$ aqueous sulfuric acid solution at a current density of 10 A/dm$^2$. The results obtained are shown in Table 3.

Subsequently, chloroiridic acid was mixed with butyl tantalate in a proportion so as to result in an iridium:tantalum molar ratio of 6:4, respectively. Thereto was added chloroplatinic acid in an amount of 5 mol % based on the total amount of the iridium and tantalum. The resulting mixture was dissolved in a mixed solvent of hydrochloric acid and butyl alcohol, thereby to prepare a coating liquid. This coating liquid was coated on the surface of each of the intermediate layers formed above, and the coating was dried and then calcined in air at 530° C. for 10 minutes. This coating and calcination operation was repeated four times to form a coating layer. Thus, electrode samples were prepared. Each electrode sample was subjected to a life test in which electrolysis was conducted in 150 g/dm$^3$ sulfuric acid having a temperature of 80° C. at a current density of 300 A/dm$^2$. The results obtained are shown in Table 3.

The results in Table 3 show that the electrode samples, in which the intermediate layers had a platinum content higher than 50 mol %, had short lives. This may be because the intermediate layers themselves were electrolytically active. Table 3 further shows that even in the case of the electrode sample in which the platinum content was zero, its life was not as long as when the platinum content in the intermediate layer was, for example, 5, 10, 25 and 50 mol %. This may be because the intermediate layer did not produce a sufficient oxygen-barrier effect.

TABLE 1

| Platinum content (%) | Electrode life (hr) |
|---|---|
| 0 | 160 |
| 0.5 | 320 |
| 1 | 430 |
| 3 | 480 |
| 6 | 460 |
| 10 | 315 |
| 20 | 90 |

TABLE 2

| Ir:Ta ratio | Electrode life (hr) |
|---|---|
| 80:14 | 360 |
| 80:19 | 360 |
| 70:29 | 380 |
| 55:44 | 330 |
| 45:54 | 240 |
| 70:29 (no intermediate layer) | 175 |

TABLE 3

| Platinum content of intermediate layer (mol %) | Potential of intermediate layer (V, vs NHE) | Electrode life (hr) |
|---|---|---|
| 0 | 3 or more | 450 |
| 1 | 3 or more | 460 |
| 5 | 2.8 | 550 |
| 10 | 2.7 | 640 |
| 25 | 2.5 | 800 |
| 50 | 2.2 | 650 |
| 70 | 1.9 | 300 |
| 90 | 1.9 | 250 |

EXAMPLE 4

Under the same conditions as in Example 3, substrates were covered with an intermediate layer having a metallic composition such that the titanium:tantalum molar ratio was 6:4, respectively, and the content of platinum was 25 mol % based on the total amount of the titanium and tantalum. On the other hand, iridium chloride was mixed with tantalum chloride in a proportion so as to result in an iridium: tantalum molar ratio of 7:3, respectively. Thereto was added chloroplatinic acid in amounts of 0, 0.5, 1, 3, 5, 10, and 20 mol % based on the total amount of iridium and tantalum. The resulting mixtures were separately dissolved in a mixed solvent of hydrochloric acid and butyl alcohol, thereby to prepare coating liquids. Each of these coating liquids was coated on the surface of the intermediate layer formed above, and the coating was dried and then calcined in air at 530° C. for 10 minutes. This coating and calcination operation was repeated four times to form coating layers. Thus, electrode samples were prepared. Each electrode sample was subjected to an accelerated electrolysis test under the same conditions as in Example 3. The results obtained are shown in Table 4.

The results (in Table 4) show that the electrode sample, in which no platinum was present in the coating layer, had an insufficient life. This may be because the coating layer containing no platinum was ineffective in improving durability. Table 4 further shows that in the case of the electrode sample in which the platinum content was higher than 10 mol %, its life was also short, far from being improved. This may be because too high a platinum content resulted in accelerated consumption of the platinum.

EXAMPLE 5

Commercially available titanium plates were sandblasted to roughen the surface of each plate. These plates were cleaned and then washed in 25 wt % sulfuric acid at 90° C. to activate the roughened surfaces. On the other hand, titanium chloride, tantalum chloride, and niobium chloride were dissolved in an aqueous hydrogen chloride solution in amounts so as to result in a titanium:tantalum: niobium molar ratio of 85:10:5, respectively, thereby to prepare a coating liquid having a free hydrogen chloride concentration of 10%. This coating liquid was coated on the activated surfaces of the substrate plates, and the coating was dried in air and then calcined at 540° C. for 10 minutes. This procedure was repeated three times to form an intermediate layer.

Subsequently, chloroplatinic acid, iridium chloride, and tantalum chloride were dissolved in boiling hydrochloric acid in amounts so as to result in a platinum:iridium:tantalum molar ratio of 2:68:30, respectively, thereby to prepare a coating liquid having a free hydrogen chloride concentration of 10%. The thus-prepared coating liquid was coated on the surface of the intermediate layer formed above, and the coating was dried and calcined. This procedure was repeated to form a coating layer.

On the surface of the coating layer of each of the thus-treated substrate plates, an aqueous solution of tantalum chloride, an alcoholic solution of tin alkoxide, or an aqueous solution of titanium chloride was coated. The resulting coatings were calcined at 530° C. for 10 minutes, thereby forming stabilizing layers having a thickness of about 0.2 μm. Thus, electrode samples were prepared.

The thus-obtained three electrode samples having a stabilizing layer were compared with an electrode sample which was the same as these electrode samples except that it did not have a stabilizing layer. All four samples were subjected to a life test in which electrolysis was conducted at a current density of 50 A/dm$^2$ in a 150 g/dm$^3$ sulfuric acid bath containing 5% of acetonitrile and having a temperature of 60° C. The results obtained are shown in Table 5.

The results (in Table 5) show that electrode life was lengthened greatly by the formation of a stabilizing layer.

EXAMPLE 6

Electrode samples were prepared in the same manner as in Example 5 except that platinum was added to the intermediate layer in an amount of 25 mol % per 100 mol % of all the intermediate layer materials. The thus-obtained electrode samples were subjected to a life test in the same manner as in Example 5, and further subjected to an accelerated life test in which electrolysis was conducted at a current density of 300 A/dm$^2$ in a 150 g/dm$^3$ sulfuric acid bath having a temperature of 80° C. The results obtained are shown in Table 6. As a control, the electrode sample evaluated in Example 5, which had no stabilizing layer, was likewise tested for life; the results obtained are shown in the lowermost section of Table 6.

The results (in Table 6) demonstrate that the intermediate layer, in which platinum had been added, functioned very effectively under conditions which might accelerate passivation, although the effect of the addition of platinum was not so significant when the electrodes were evaluated under conditions which consumed the surface electrode material as in the acetonitrile bath. Table 6 further shows that in either case, the formation of a stabilizing layer was effective in lengthening electrode life.

TABLE 4

| Platinum content of coating layer (mol %) | Electrode life (hr) |
|---|---|
| 0 | 250 |
| 0.5 | 440 |
| 1 | 540 |
| 3 | 690 |
| 5 | 750 |
| 10 | 600 |
| 20 | 300 |

TABLE 5

| Stabilizing layer | Electrode life (hr) |
|---|---|
| None | 350 |
| Tantalum oxide | 630 |
| Tin oxide | 550 |
| Titanium oxide | 580 |

TABLE 6

| Stabilizing layer | Electrode life in acetonitrile electrolysis (hr) | Electrode life in sulfuric acid electrolysis (hr) |
|---|---|---|
| None | 340 | 800 |
| Tantalum oxide | 630 | 1120 |
| Tin oxide | 640 | 1150 |
| Titanium oxide | 590 | 930 |
| None (note) | 350 | 450 |

(note)
No platinum in the intermediate layer.

As described above, the electrolytic electrode provided in the first embodiment of the present invention comprises a substrate made of a valve metal, an intermediate layer formed on a surface of the substrate and containing an oxide of at least one metal selected from the group consisting of niobium, tantalum, titanium, and zirconium, and a coating layer formed on the intermediate layer and containing an iridium-tantalum mixed oxide and platinum.

In this electrode, the coating layer contains platinum in addition to the electrode materials, i.e., iridium oxide and tantalum oxide, and the platinum has been added to the crystalline structure of iridium and tantalum to form a solid solution, thereby making the crystalline state better. Therefore, the presence of platinum in the coating layer serves to improve the durability and corrosion resistance of the electrode, and; hence, the life of the electrode can be lengthened considerably. Since platinum is inferior in electrode activity to either of iridium and tantalum, the activity of the coating layer in the electrolytic electrode of the present invention is equal to or slightly lower than that of a coating layer containing no platinum and consisting of iridium oxide and tantalum oxide only. However, due to the good crystalline structure of the coating layer, the electrolytic electrode of the present invention shows excellent durability and has a far longer life than electrolytic electrodes having a coating layer containing no platinum.

It is desirable that in the coating layer of the electrolytic electrode of the present invention, the contents of iridium, tantalum, and platinum are from 50 to 70 mol %, from 20 to 49.5 mol %, and from 0.5 to 10 mol %, respectively. This is partly because if the molar content of iridium is higher than that of tantalum, a stable rutile-type crystalline structure is formed with difficulty and, at the same time, such a high iridium content results in a slight increase in potential when the electrode is used in oxygen-generating electrolysis. When platinum is added to the coating layer only in an amount required to allow the platinum to be solid-solubilized in the crystalline structure of the iridium and tantalum to form a good crystalline structure. The effects of the presently claimed invention are seen. If the platinum content is too high, the platinum functions as an electrode material during electrolysis and is apt to dissolve into the electrolyte solution leading to breakage of the coating layer.

The electrolytic electrode provided in the second embodiment of the present invention is the same as the electrode according to the first embodiment of the invention except that platinum has been added to the intermediate layer. Although use of the electrolytic electrode according to the first embodiment of the invention does not pose any problem so long as electrolysis is conducted under ordinary conditions, the electrode may suffer peeling of the intermediate layer or formation of a passive-state layer due to penetration of electrolytically generated oxygen when the electrode is used under severe conditions as in zinc plating. In this case, by adding platinum, which has an oxygen-barrier effect, to the intermediate layer, the penetration of oxygen is inhibited and the peeling of the intermediate layer and the formation of a passive-state layer are also prevented. Therefore, an electrolytic electrode having a long life even under severe use conditions can be provided.

The electrolytic electrode provided in the third embodiment of the present invention is the same as the . electrode according to the first embodiment of the invention except that a stabilizing layer containing an oxide of at least one metal selected from the group consisting of tin, titanium, tantalum, zirconium, and niobium has been formed on the coating layer.

In some cases, even the electrolytic electrode according to the first embodiment of the invention, which comprises a substrate and formed thereon an intermediate layer and a coating layer, has a relatively shorter life. In such a case, the life of the electrolytic electrode can be further lengthened to a satisfactory extent by forming a stabilizing layer of the above-described kind.

The electrolytic electrode provided in the fourth embodiment of the present invention is the same as the electrode according to the second embodiment of the invention except that a stabilizing layer containing an oxide of at least one metal selected from the group consisting of tin, titanium, tantalum, zirconium, and niobium has been formed on the coating layer.

In some cases, even the electrolytic electrode according to the second embodiment of the invention, which comprises a substrate and formed thereon an intermediate layer and a coating layer, has a relatively shorter life, although the electrode has been improved in durability due to the platinum added to both the intermediate layer and the coating layer and can hence still have a lengthened life. In such a case, the life of the electrolytic electrode can be further lengthened to a more satisfactory extent by forming a coating layer of the above-described kind.

While the invention has been described in detail and with reference to specific embodiments thereof, it will be apparent to one skilled in the art that various changes and modifications can be made therein without departing from the spirit and scope thereof.

What is claimed is:

1. An electrolytic electrode comprising a substrate made of a valve metal, an intermediate layer formed on a surface of the substrate containing an oxide of at least one metal selected from the group consisting of niobium, tantalum, titanium, and zirconium, and a coating layer formed on the intermediate layer containing an iridium-tantalum mixed oxide and platinum, wherein the contents of iridium, tantalum, and platinum in the coating layer are from 50 to 70 mol %, from 20 to 49.5 mol %, and from 0.5 to 10 mol %, respectively.

2. An electrolytic electrode as claimed in claim 1, wherein the content of platinum in said coating layer is 2 to 6 mol %.

3. An electrolytic electrode comprising a substrate made of a valve metal, an intermediate layer formed on a surface of the substrate containing platinum and an oxide of at least one metal selected from the group consisting of niobium, tantalum, titanium, and zirconium, and a coating layer formed on the intermediate layer containing an iridium-tantalum mixed oxide and platinum, wherein the contents of iridium, tantalum, and platinum in the coating layer are formed 50 to 70 mol %, from 20 to 49.5 mol %, and from 0.5 to 10 mol %, respectively.

4. An electrolytic electrode as claimed in claim 3, wherein the content of platinum in said coating layer is 2 to 6 mol %.

5. An electrolytic electrode comprising a substrate made of a valve metal, an intermediate layer formed on a surface of the substrate containing an oxide of at least one metal selected from the group consisting of niobium, tantalum, titanium, and zirconium, a coating layer formed on the intermediate layer containing an iridium-tantalum mixed oxide and platinum, and a stabilizing layer formed on the coating layer containing an oxide of at least one metal selected form the group consisting of tin, titanium, tantalum, zironcium, and niobium, wherein the contents of iridium, tantalum, and platinum in the coating layer are from 50 to 70 mol %, from 20 to 49.5 mol %, and from 0.5 to 10 mol %, respectively.

6. An electrolytic electrode as claimed in claim 5, wherein the content of platinum in said coating layer is 2 to 6 mol %.

7. An electrolytic electrode comprising a substrate made of a valve metal, an intermediate layer formed on a surface of the substrate containing platinum and an oxide of at least one metal selected from the group consisting of niobium, tantalum, titanium, and zirconium, a coating layer formed on the intermediate layer containing an iridium-tantalum mixed oxide and platinum, and a stabilizing layer formed on the coating layer containing an oxide of at least one metal selected from the group consisting of tin, titanium, tantalum, zironcium, and niobium, wherein the contents of iridium, tantalum, and platinum in the coating layer are from 50 to 70 mol %, from 20 to 49.5 mol %, and from 0.5 to 10 mol %, respectively.

8. An electrolytic electrode as claimed in claim 7, wherein the content of platinum in said coating layer is 2 to 6 mol %.

* * * * *